US011753201B2

(12) United States Patent
Mueller et al.

(10) Patent No.: US 11,753,201 B2
(45) Date of Patent: Sep. 12, 2023

(54) DISPENSING PACKAGE

(71) Applicants: Richard W. Mueller, Palm Harbor, FL (US); Martin J. Mueller, Palm Harbor, FL (US)

(72) Inventors: Richard W. Mueller, Palm Harbor, FL (US); Martin J. Mueller, Palm Harbor, FL (US)

(73) Assignee: MUELLCO PARTNERS, LLC, Oldsmar, FL (US)

( * ) Notice: Subject to any disclaimer, the term of this patent is extended or adjusted under 35 U.S.C. 154(b) by 123 days.

(21) Appl. No.: 17/230,687

(22) Filed: Apr. 14, 2021

(65) Prior Publication Data

US 2021/0323714 A1 Oct. 21, 2021

Related U.S. Application Data

(60) Provisional application No. 63/012,527, filed on Apr. 20, 2020.

(51) Int. Cl.
*B65D 3/10* (2006.01)
*B65D 3/06* (2006.01)
(Continued)

(52) U.S. Cl.
CPC ..... *B65D 3/10* (2013.01); *B65D 3/06* (2013.01); *B65D 3/28* (2013.01); *B65D 35/02* (2013.01); *B65D 35/14* (2013.01)

(58) Field of Classification Search
CPC ... B65D 3/10; B65D 3/06; B65D 3/28; B65D 35/02; B65D 35/14; B65D 3/20;
(Continued)

(56) References Cited

U.S. PATENT DOCUMENTS 1,272,921 A * 7/1918 Crump ..... B65D 35/12 222/107
1,738,779 A * 12/1929 Lockwood ..... B65D 3/06 229/405

(Continued)

FOREIGN PATENT DOCUMENTS

KR 20160022189 A * 2/2016
WO WO-2012123742 A2 * 9/2012 ..... A23L 1/05

*Primary Examiner* — Christopher R Demeree
(74) *Attorney, Agent, or Firm* — Wood, Phillips, Katz, Clark & Mortimer

(57) ABSTRACT

A dispensing package for holding and dispensing food products, such as yogurts, frozen confections, custards, and the like, and may comprise a unitary, one-piece package body preferably comprising wicking-resistant, polymer-coated paperboard material which is liquid impermeable. Non-coated paperboard may alternatively be employed. The package body includes a sidewall having a generally elongated, downwardly and inwardly tapering configuration, and can include a crimped bottom. The sidewall is inwardly deformable so that inward deformation urges product within the package upwardly through the open mouth of the package for dispensing the product. The package can alternatively be configured with a flat bottom, and include a horizontal, bottom flex panel to facilitate deformation of the package for dispensing product. This embodiment permits the package to be readily positioned in a standing, upright orientation during consumption so that product does not inadvertently flow from the package.

17 Claims, 3 Drawing Sheets

(51) Int. Cl.
*B65D 35/02* (2006.01)
*B65D 35/14* (2006.01)
*B65D 3/28* (2006.01)

(58) Field of Classification Search
CPC .... B65D 83/0094; B65D 85/72; B65D 85/78; B65D 3/14; B65D 77/2032; B65D 43/02; B65D 35/28; B65D 75/5866; B65D 77/20; A47G 19/03
USPC ..... 229/4.5, 400, 404, 405, 5.6; 206/277; 220/62.22; 222/92, 541.6, 107; 215/900; 221/64; 383/104, 121; 426/115
See application file for complete search history.

(56) References Cited

U.S. PATENT DOCUMENTS

| | | | | | |
|---|---|---|---|---|---|
| 1,738,782 | A | * | 12/1929 | Main | B65D 3/06 383/122 |
| 3,170,568 | A | | 2/1965 | Carter | |
| 3,313,455 | A | * | 4/1967 | Kemmer | B65D 35/28 206/277 |
| 3,905,539 | A | * | 9/1975 | Cousins | B65D 3/08 229/4.5 |
| 4,792,086 | A | * | 12/1988 | Chen | A45F 3/20 229/117 |
| 4,875,620 | A | | 10/1989 | Lane, Sr. | |
| 7,677,435 | B2 | | 3/2010 | Stahlecker | |
| 11,407,578 | B1 | * | 8/2022 | Bouse | B65D 81/3876 |
| 2006/0249534 | A1 | | 11/2006 | Sainz | |
| 2013/0122155 | A1 | | 5/2013 | Mueller | |

* cited by examiner

Fig. 1
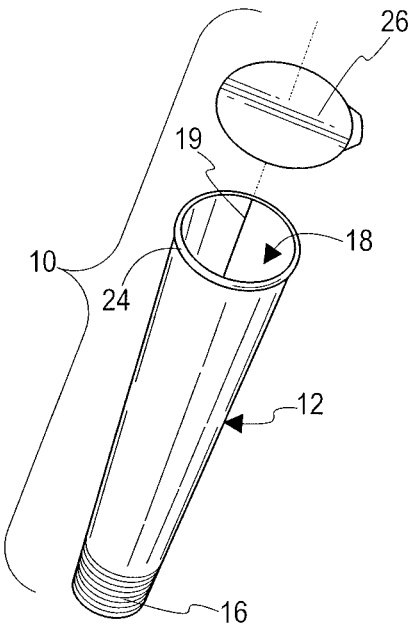
Fig. 2
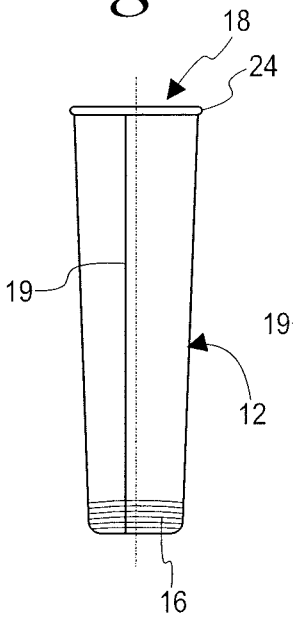
Fig. 3
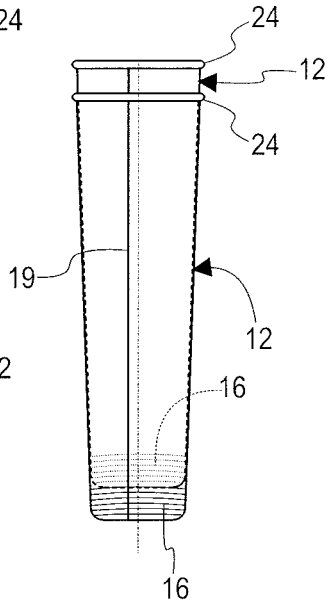
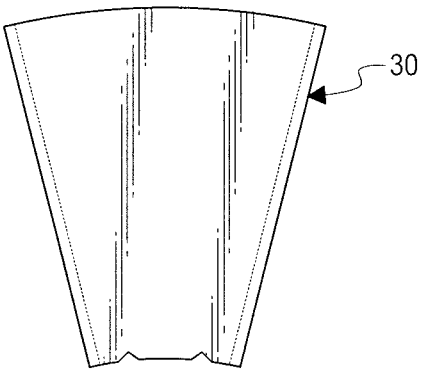
Fig. 4

Fig. 5
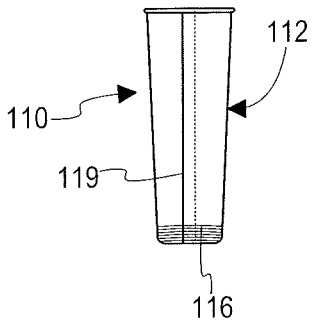
Fig. 6
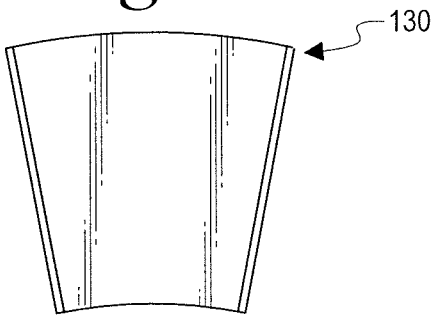
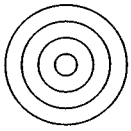
Fig. 7a
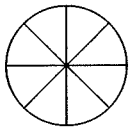
Fig. 7b
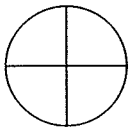
Fig. 7c
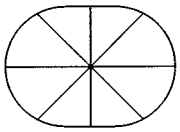
Fig. 7d
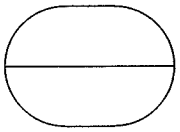
Fig. 7e

DISPENSING PACKAGE

CROSS-REFERENCE TO RELATED APPLICATIONS

This application claims priority of Provisional Ser. No. 63/012,527, filed Apr. 20, 2020, the disclosure of which is hereby incorporated by reference in its entirety.

FEDERALLY SPONSORED RESEARCH OR DEVELOPMENT

Not Applicable.

MICROFICHE/COPYRIGHT REFERENCE

Not Applicable.

FIELD OF THE INVENTION

The present invention is directed generally to a dispensing package suitable for holding and dispensing individual servings of food products such as frozen or refrigerated confections, custards, yogurts, and the like, and more particularly to a dispensing package having a deformable package body which preferably comprises wicking-resistant paper, which resists wicking to preserve package and product integrity. A sidewall of the package body is inwardly deformable by manipulation of the package so that product within the package is urged upwardly for dispensing product from within the package body. The package can also have a unique flat bottom, which may be configured to flex or deform without leakage, to permit the package to be placed in a standing or upright orientation.

BACKGROUND OF THE INVENTION

For many food products, it is desirable to provide single-serve packages by which individual servings of the product can be packaged, stored, shipped, and eventually handled by the consumer. Single-serve packages of this type can be used for a wide variety of food products, including frozen confections, puddings, yogurts, and like semi-liquid comestibles and liquids.

For some single-serve packages, it is desirable that the food product can be dispensed and consumed without use an associated spoon or other utensil. By way of example, "push-up" type containers frequently used for frozen confections include an outer cylindrical tube, typically formed from spirally-wound paper, with an associated piston-like plunger which can be manipulated to push the frozen product upwardly through the outer tube for consumption. For some types of food products, it is desirable to provide a dispensing package which can be squeezed and deformed in order to urge the food product upwardly and outwardly for consumption. It is believed that this type of container can be advantageously employed for semi-liquid products, such as yogurt, custard, and the like.

The present invention is directed to a dispensing package which facilitates dispensing of a frozen or non-frozen, semi-liquid food product such as yogurt or custard, by squeezing and deforming the package, without use of an associated utensil. Notably, the present package is preferably configured from wicking-resistance paperboard material, with economic and convenient use of the package thus facilitated. It can also be of a stand-up design with a flat squeezable bottom, or an angled bottom. The package can include a bottom panel which can flex, or at least partially collapse, to facilitate product dispensing, while maintaining the integrity of the package against leakage.

SUMMARY OF THE INVENTION

A dispensing package embodying the principles of the present invention comprises a package body within which a frozen or non-frozen, semi-liquid food product such as yogurt or custard can be packaged. Notably, the package is configured to facilitate convenient dispensing and consumption of the food product without use of an associated utensil or the like, by merely squeezing and inwardly deforming the package, whereby the food product is dispensed upwardly through an open mouth of the package. This arrangement facilitates convenient dispensing and consumption of product. The preferred manufacture of the present package from polymer-coated paper, or other water-resistant "eco" plant-based papers, renders the package substantially impermeable to liquid, thus facilitating use for non-frozen products. The material from which the package body is formed desirably resists wicking, thereby preserving the product and the integrity of the package.

In accordance with the illustrated embodiments, the package includes a package body having a sidewall preferably having a generally elongated, downwardly and inwardly tapering configuration. In certain embodiments, the sidewall of the package body has a crimped, closed lower end at the bottom of the sidewall, with an upper portion of the sidewall terminating at an open mouth, opposite the closed end, for dispensing product from within the package.

In other embodiments of the present invention, the dispenser package is preferably generally frusto-conical, having a generally flat bottom to permit the package to stand upright. An important feature of these embodiments is that the package, even after opening, is able to stand up, in an upright orientation, while the package is still squeezable and deformable for dispensing product. When this feature is employed, the consumer can enjoy a portion of the product, but still be able to set the package down for a few moments, and not spill the product, before finishing the product. The flat-bottomed embodiments can be provided with a collapsible, bottom flex panel. Thus, the package can still be squeezable, but does not have to held in the hand of the consumer at all times during consumption. This is in distinction from the embodiment having a crimped bottom, since this version cannot self-stand, and product could inadvertently flow from the open package if it is placed on its side.

In accordance with the illustrated embodiments, the package includes an overturned edge portion at the upper portion of the sidewall of the package body. In the preferred form, the overturned edge of the sidewall defines an annular surface to facilitate sealing of the package by application of the seal member to the surface. The seal member is preferably provided in the form of a suitable heat-sealable foil or the like.

While the specific configuration of the package body can be varied while keeping with the principles disclosed herein, in the illustrated embodiments, the sidewall of the package body is generally inwardly and downwardly tapered, and facilitates nested stacking of plural ones of the package bodies. In the illustrated embodiments, the closed lower end of the package body includes a flattened, sealed region, such that the package body tapers from a generally circular configuration of the open mouth of the package body, to a generally elliptical cross-section. This configuration of the package body presents opposed, gripping surfaces which can be deformed inwardly toward each other such as by pinching for urging product upwardly for dispensing and consumption.

Economical formation of the present package from liquid impermeable polymer-coated paper provides economical manufacture, while maintaining the integrity of the package, is presently contemplated. It is presently contemplated that the package be provided with a volume on the order of approximately 40-180 ml, with the specific package material, and sidewall thickness, selected to facilitate convenient manipulation and squeezing of the package for product dispensing. Alternatively, the package can be formed from a substantially liquid-impermeable paper that does not include a polymer coating, with a suitable adhesive employed for closing and sealing the package structure.

In accordance with another aspect of the present invention, it is contemplated that the present dispensing package be provided with a lower or bottom panel or portion that can flex, or at least partially collapse, by manipulation of the package while dispensing product. This facilitates dispensing of the contents of the package for convenient consumption. Various arrangements are disclosed herein for this configuration of the package, including scoring of the bottom panel to facilitate flexing, and configuring the bottom panel to extend substantially above an annular seal region which joins the bottom panel to the sidewall of the package body.

The present package is particularly versatile in use. The package can be employed for refrigerated products. Additionally, the packaged product can easily be transferred from the refrigerator to the freezer. The frozen product can then easily be placed in a child's lunchbox or the like for later consumption, or can be consumed directly from the freezer in frozen form.

Other features and advantages of the present invention will become readily apparent from the accompanying drawings and the appended claims.

BRIEF DESCRIPTION OF THE DRAWINGS

FIG. 1 is an exploded, perspective view of a dispensing package embodying the principles of the present invention;

FIG. 2 is a diagrammatic, rear elevational view, of a package body thereof;

FIG. 3 is a diagrammatic view similar to FIG. 2 showing plural ones of the package bodies in a stacked, nested configuration;

FIG. 4 is a diagrammatic view of the coated paper material from which the package body of the present invention is formed.

FIG. 5 are diagrammatic, rear elevational view of an alternative embodiment of the present dispensing package, having a flat bottom so the package can assume a standing, upright orientation;

FIG. 6 is a diagrammatic view of the coated paper material from which a package body of the embodiment of FIG. 5 is formed;

FIGS. 7*a-e* are diagrammatic views of optional scoring of a bottom flex panel of the type of package illustrated in FIG. 5 to facilitate preferential flexing of the panel.

DETAILED DESCRIPTION OF THE PREFERRED EMBODIMENT

Figure 8A:
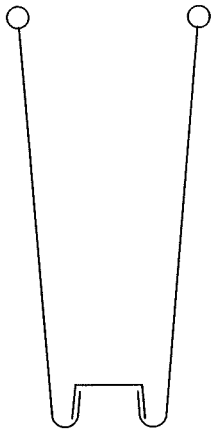
FIGS. 8*a-f* are diagrammatic views of package bottom panels, including bottom flex panels and associated sidewalls configured in accordance with the present invention.

While this invention is susceptible of embodiment in various forms, there is shown in the drawings and will hereinafter be described presently preferred embodiments, with the understanding that the present disclosure is to be considered as an exemplification of the invention, and is not intended to limit the invention to the specific embodiments illustrated.

With reference first to FIGS. 1-4, therein is illustrated a first embodiment of a dispensing package 10 embodying the principles of the present invention. The specific size, shape, and configuration of the present dispensing package can be widely varied, while keeping with the principles disclosed herein. As will be described, the present dispensing package is configured for convenient dispensing and consumption of a food product, such as frozen custard, frozen yogurt and like comestibles, by gripping, squeezing, pinching and inwardly deforming a sidewall of the package, so that product within the package is forced upwardly through the open mouth of the package, for convenient consumption by consumers.

In this illustrated embodiment, the dispensing package 10 has a generally elongated configuration, including a unitary, one-piece package body 12 having a sidewall having a generally elongated, downwardly and inwardly tapering configuration. The sidewall of the package has a closed, flattened lower end 16 at the bottom of the sidewall, with an upper end of the sidewall terminating at a circular open mouth 18, opposite closed end 16, for dispensing product from within the package.

In one preferred embodiment, the one-piece package body 12 comprises polymer-coated paper material, which is liquid impermeable. The sidewall of the package body is preferably formed with a single seam 19, which can be heat-sealed, or adhesively formed. The package body can be efficiently formed from a single piece of material 30, as shown in FIG. 4, which can be shaped to the desired generally tapered configuration, with the bottom of the package body closed and sealed at lower end 16.

Notably, formation of the package body 12 from a polymer-coated a food grade paperboard has been found to provide the desired integrity of the present package and its contents. This type of paperboard desirably resists wicking or like degradation, but can still be formed, and sealed using the polymer (typically polyethylene) counting on the outside or inside layers of the tube and paper. This type of package employs less plastic than a typical all-plastic package, and is therefore more environmentally friendly.

Alternatively, water-resistant paper, such as processed by the coating process of Wood Holdings, without a polymer coating, can be employed. This type of material typically requires use of an adhesive for closing and sealing the package body. This type of material has the benefit of being biodegradable, while providing the desired liquid-holding characteristics. This type of material can be advantageously employed for replacement of polymer-based cups and containers with a "earth-friendly", biodegradable package.

By virtue of the flattened, closed lower end 16 of the package body 12, the sidewall of the body has a generally elliptical cross-section to facilitate manipulation and squeezing for urging product upwardly through the package body, with the inwardly tapering sidewall being shaped to transition from the circular open mouth 18 to the generally flattened, closed lower end 16. Thus, the package body presents generally opposed, generally flattened, inwardly tapering gripping surfaces which can be deformed inwardly toward each other, such as by squeezing or pinching, for urging product upwardly and outwardly through the open mouth 18 of the package for dispensing the product.

In accordance with this illustrated embodiment, the upper portion of the package body includes an overturned edge portion 24. The overturned edge portion 24 acts to rigidify the package, and provides a surface for receiving a seal member 26 for the package, such as by heat-seal application.

As noted, the present dispensing package has a generally elongated configuration, but again, the specific dimensions and configuration of the package can be widely varied while keeping with the principals disclosed herein. By way of example, the illustrated dispensing package 10 has a height, i.e. length, and has a diameter at the upper portion of the sidewall of the package. It is contemplated that in the preferred form, the ratio of the height of the package to its diameter is in a range from about 2.5:1 to about 5:1.

In an alternative embodiment of the present invention, shown in FIGS. 5 and 6, a package 110 includes a package body 112, and is preferably provided with a generally frusto-conical configuration, including a flat, generally horizontal bottom portion, including a bottom flex panel 116 to permit the package to be free-standing in an upright orientation. This allows the package 110 to stand in upright orientation during consumption, which is believed to be a unique and desirable feature. The generally frusto-conical configuration facilitates nesting of plural packages for use with automated filling equipment. A generally cylindrical, non-tapering sidewall can alternatively be provided.

In accordance with another aspect of the present invention, it is contemplated that the present dispensing package be provided with the lower or bottom flex panel 116 or like portion that can flex, or at least partially collapse, by manipulation of the package while dispensing product. This facilitates dispensing of the contents of the package 110 for convenient consumption. Various arrangements are disclosed herein for this configuration of the package.

In accordance with this embodiment, the present dispensing package 110 comprises the package body 112 including a sidewall, with the package body 112 having a closed lower end at the bottom of the sidewall. An upper portion of the sidewall terminates at an open mouth of the package body, opposite the closed lower end, for dispensing product from within the package. A suitable seal, no shown, is removable secured to the package at the open mouth thereof of closing the package and its contents prior to consumption.

As in the previous embodiment, the sidewall of the package body 112 comprises a single piece of paper 130, as shown in FIG. 6, which is preferably selected to resist wicking, forming the package body with a single vertical seam. The package body 112 can have a generally frusto-conical, inwardly and downwardly tapering configuration, or may be generally cylindrical. A seal member is sealed to the open mouth of the package body, with the seal member being removable to uncover the open mouth of the package body, so that the sidewall can be inwardly deformed for dispensing product from within the package through the open mouth.

As noted, in this embodiment of the invention, the package body includes a generally horizontal, bottom flex panel 116 positioned at the bottom of the sidewall to facilitate dispensing of product from within the package 110, while also permitting the package to assume an upright, standing orientation. The bottom flex panel 116 is deformable, by manipulation of the package, so that the panel deforms, or at least partially collapses, from a generally planar, initial configuration.

Figure 8B:
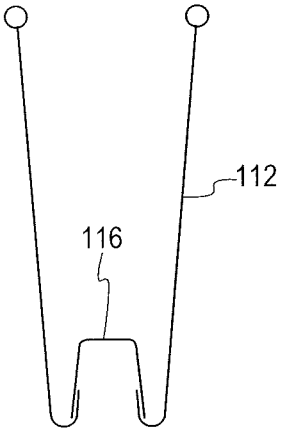
Figure 8C:
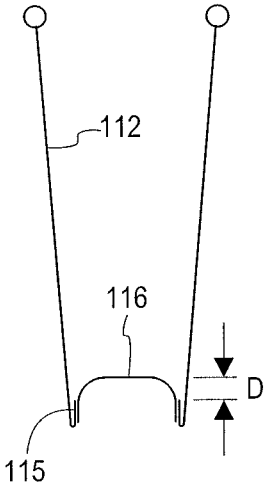
Figure 8D:
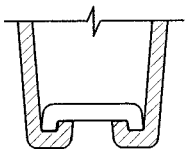

The bottom flex panel 116 can have any of a variety of specific configuration. For example, the bottom flex panel 116 can be generally concave, extending upwardly into the sidewall of the package body, as diagrammatically illustrated in FIG. 8*c*. The bottom flex panel 116 may comprise an oval-shaped panel, as diagrammatically illustrated in FIGS. 8*d* and 8*e*, to facilitate flexing by manipulation of the package body. Such an oval-shaped panel may be elliptical, ovoid, or otherwise shaped to facilitate flexing along either the major or minor axis of the panel.

As shown in the accompanying illustrations in FIGS. 7*a-e*, the bottom flex panel 116 may comprise scoring to facilitate flexing by manipulation of the package body. The scoring of the lower panel creates regions at which the panel preferentially flexes or bends to facilitate product dispensing. Such scoring my comprise a single score line (see FIG. 7*e*), or multiple scores arranged in one of any of a variety of patterns, such as concentric circles (FIG. 7*a*), star-shaped (FIGS. 7*b* and 7*d*, or cross-shaped (FIG. 7*c*). Scoring may be provided on an oval-shaped bottom flex panel, as illustrated.

In the presently preferred practice, this scoring is done prior to application of the bottom panel stock when the bottom stock is die cut out into the round shape. Scoring can be varied while keeping with present invention, such as a single score, or a "cross" shaped score, an "X-shaped" score, or other type lines across the bottom panel to help the bottom paper crease and not break during consumer compression. This is aided by utilizing additional thickness of plastic on the paper. The thickness of the plastic can vary depending on the diameter of the container, depending upon what is required to prevent the package from breaking during hand compression.

Additionally, the depth of the annual side seal region on the bottom of the package is lengthened, and scored during the bottom rolling sealing process to offer additional strength to the bottom of the package. This, in combination with the scoring and the material selection, allows hand compression of the bottom of the package to squeeze out the product, and not break or crack through the container holding the product within, and not leaking out into the consumer's hand.

An additional benefit of this design is that even after squeezing, the package 110 can be reshaped or pressed back into shape to allow it to continue to stand in an upright position so that the product within can be consumed at a slower basis. Allowing the consumer to "eat-squeeze-eat" and let the package stand in between. This is a distinct advantage to our containers which must be held as the consumer consumes the product and until it is completed and disposed of.

Figure 8E:
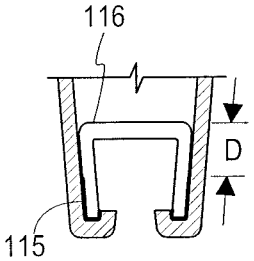
Figure 8F:
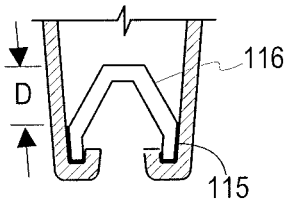

Another aspect of the present invention contemplates that the bottom flex panel of the package be provided by configuring the flex panel to cooperate with the lower seal between the package body and the flex panel, with an annular seal region of the package designated at 117. As shown in the accompanying illustrations in FIGS. 8*b* and 8*c*, the sidewall of the package body 112 includes in in-turned lower edge portion that is sealed to a down-turned, peripheral edge portion of the bottom flex panel 116. In one illustrated embodiment, FIG. 8*b*, the die-cut bottom flex panel 116 extends upwardly from the sealed, peripheral edge portion, and thus is formed deeper that a standard cup bottom (shown in FIG. 8*a*). A standard bottom cup is typically sealed all the way to the top of the bottom panel (see FIG. 8*d*). In contrast, the bottom flex panel 116 is sealed as much as the standard cup, or optionally a small amount more for added strength, but contemplates that a significant portion of the flex panel to the top be unsealed. This unsealed portion, which extends upwardly from sealed, peripheral edge portion as shown in FIGS. 8*e* and 8*f*, becomes the flex panel, and acts in the nature of an accordion, in a way to allow the package bottom to be compressed, and the bottom to flex and not tear or break. Thus, leakage is avoided.

In the illustrated embodiments, the bottom flex panel 116 is joined to the sidewall of the package body by an annular seal region 115 having a vertical dimension, wherein the associated bottom flex panel 116 extends upwardly from the annular seal region 115 by a distance "D" that is preferably at least as great as the vertical dimension of the annular seal region.

During development of the present invention, it has been recognized that use of paper which resists wicking facilitates use of the package for non-frozen products such as yogurt. As noted, to this end, polymer-coated paper can be advantageously employed. However, it has been recognized the package must be configured, at the bottom flex panel 116, to resist leakage when to package is squeezed and deformed.

Thus, it is contemplated that at least one of package body and bottom flex panel include a polymer coating that functions to form a seal that resists leakage from the package attendant to flexing of the bottom flex panel, and dispensing of product from the package. Specifically, it is contemplated that a sufficiently thick polymer coating be provided, on at least one of the sidewall and the bottom flex panel, that can allow the paper to tear or rupture, while the polymer coating stretches, to maintain the integrity of the sealed region, and prevent leakage of the package.

Affordable use of the present package is an important objective, and the typical polymer coating adds expense. While a typical polymer coating may comprise a 0.5 mil coating on one side, and a 0.75 mil coating on the other, these specific coating thicknesses can be varied to achieve the desired sealing integrity. It can be desirable, and cost-effective, to provide one side of the paper with a relatively thick coating, such as 1.5 mils for example, to form the seal between the flex panel and the sidewall, with minimal polymer coating on the other side of the paper. The objective is to provide a polymer coating which is sufficient to allow deformation and stretching of the bottom sealed region, while allowing the polymer to stretch as required and not tear, even if the paper substrate tears, and avoid leakage from the package. A relatively larger sealed region between the sidewall and the lower flex panel can be effective for abating leakage.

In a current embodiment, a base stock caliper of 0.008 has been used, and a total of 2.0 mils of polymer coating (1.5 mil/0.5 mil) applied; the targeted finished caliper is 0.010, which can vary slightly.

It is presently contemplated that the present package be configured from wicking-resistance paperboard material, which may comprise polymer-coated paper, for economic and convenient use. However, it is within the purview of the present invention that other types of packaging material can be employed for practicing the novel features of the invention. Such materials potentially include those formulated for biodegradability and/or composting, with such materials preferably exhibiting substantial liquid impermeability.

In accordance with the present invention, a method of dispensing a food product for consumption comprises the steps of providing a package having package body comprising a sidewall and having a closed lower end. The package includes an open mouth opposite the closed lower end for dispensing product from within the package. The package includes a bottom flex panel joined to the sidewall to facilitate dispensing of product from within the package.

The present method further contemplates filling package with the food product, and dispensing the food product from within the package, through the open mouth, by inwardly deforming the sidewall of the package body. In accordance with the present invention, this includes deforming the bottom flex panel without separating the bottom flex panel from the sidewall.

Dispensing of the food product from within the package can be facilitated by scoring said bottom flex panel during package formation to facilitate deforming the bottom flex panel. Dispensing can further be facilitated by joining the bottom flex panel to the sidewall by an annular seal region, with bottom flex bottom extending upwardly from the annular seal region.

From the foregoing, it will be observed that numerous modifications and variations can be effected without departing from the true spirit and scope of the novel concept of the present invention. It is to be understood that no limitation with respect to the specific embodiments illustrated herein is intended or should be inferred. The disclosure is intended to cover by the appended claims all such modifications which fall within the scope of the claims.

The invention claimed is:

1. A dispensing package, comprising:

a package body including a unitary sidewall having a generally elongated, downwardly and inwardly tapering configuration, said sidewall of said package body having a closed lower end at the bottom of said sidewall, with an upper portion of said sidewall terminating at an open mouth, opposite said closed lower end, for dispensing product from within said package, said package body comprising a single piece of wicking-resistant, polymer-coated paper, said package body formed by joining portions of the single piece to produce a single vertical seam; and a seal member sealed to said open mouth of said package body, said seal member being removable to uncover said open mouth of said package body, so that the sidewall of said package body can be inwardly deformed by being gripped and squeezed for dispensing product from within said package that is forced upwardly through said open mouth.

2. A dispensing package in accordance with claim 1, wherein said sidewall of said package body includes an overturned edge portion at the upper portion of said sidewall to which said first seal member is applied after filling of said package body with product to be dispensed.

3. A dispensing package in accordance with claim 1, wherein said package body has a generally flattened, closed and sealed bottom portion, whereby said package body has a generally elliptical cross-section.

4. A dispensing package in accordance with claim 1, wherein said package body has a generally frusto-conical configuration, and includes a generally horizontal lower portion to permit said package to assume an upright, standing configuration.

5. A dispensing package in accordance with claim 4, wherein said lower portion comprises a bottom flex panel which comprises scoring to facilitate flexing by manipulation of said package body.

6. A dispensing package in accordance with claim 1, wherein said lower portion comprises a bottom flex panel joined to said sidewall of said package body by an annular seal region having a vertical dimension, said bottom flex panel extending upwardly from said annular seal region.

7. A dispensing package in accordance with claim 1, wherein said dispensing package has a height, and has a diameter at said upper portion of said sidewall, wherein the ratio of said height to said diameter is in a range from about 2.5:1 to about 5:1.

8. A dispensing package, comprising:

a package body including a sidewall, said package body having a closed lower end at the bottom of said sidewall, with an upper portion of said sidewall terminating at an open mouth of said package body, opposite said closed lower end, for dispensing product from within said package, said sidewall of said package body comprising a single piece of paper formed by joining portions of the single piece to produce a single vertical seam;

said package body including a generally horizontal, bottom flex panel positioned at the bottom of said sidewall to facilitate dispensing of product from within said package; and a seal member sealed to said open mouth of said package body, said seal member being removable to uncover said open mouth of said package body, so that the sidewall of said package body can be inwardly deformed by being gripped and squeezed for dispensing product from within said package that is forced upwardly through said open mouth.

9. A dispensing package in accordance with claim 8, wherein said bottom flex panel comprises an oval-shaped panel to facilitate flexing by manipulation of said package body.

10. A dispensing package in accordance with claim 8, wherein said bottom flex panel comprises scoring to facilitate flexing by manipulation of said package body.

11. A dispensing package in accordance with claim 8, wherein said sidewall of said package body includes in in-turned lower edge portion that is sealed to a down-turned, peripheral edge portion of said bottom flex panel, said bottom flex panel extending upwardly from said peripheral edge portion.

12. A dispensing package in accordance with claim 8, wherein said sidewall of said package body includes in in-turned lower edge portion that is sealed to a down-turned, peripheral edge portion of said bottom flex panel, said bottom flex panel extending upwardly from said peripheral edge portion, said bottom flex panel comprising scoring to facilitate flexing by manipulation of said package body.

13. A dispensing package in accordance with claim 8, wherein said package body having a generally frusto-conical configuration, said sidewall having a generally elongated, downwardly and inwardly tapering configuration, said bottom flex panel being positioned at the bottom of said inwardly tapering sidewall.

14. A dispensing package in accordance with claim 8, wherein said package body comprises wicking-resistant, polymer-coated paper.

15. A dispensing package in accordance with claim 14, wherein at least one of said package body and said bottom flex panel includes a polymer coating to form a seal between said package body and said bottom flex panel that resists leakage from said package attendant to flexing of said bottom flex panel and dispensing of product from said package.

16. A dispensing package in accordance with claim 8, wherein said bottom flex panel is joined to said sidewall of said package body by an annular seal region having a vertical dimension, said bottom flex panel extending upwardly from said annular seal region by a distance greater than said vertical dimension.

17. A dispensing package in accordance with claim 8, wherein said bottom flex panel comprises scoring to facilitate flexing by manipulation of said package body.

* * * * *